US005477568A

United States Patent [19]

Wang

[11] Patent Number: 5,477,568

[45] Date of Patent: Dec. 26, 1995

[54] BATHTUB ASSEMBLY

[76] Inventor: Sung-Shun Wang, 58, Ma Yuan West St., Taichung, Taiwan

[21] Appl. No.: 390,298

[22] Filed: Jan. 3, 1995

[51] Int. Cl.[6] ..... A47K 3/16

[52] U.S. Cl. ..... 4/592

[58] Field of Search ..... 4/592, 593, 594

[56] References Cited

U.S. PATENT DOCUMENTS

| | | | |
|---|---|---|---|
| 1,116,015 | 11/1914 | Clifford | 4/594 |
| 4,551,869 | 11/1985 | Whitney | 4/593 X |
| 5,241,713 | 9/1993 | Wang | 4/593 |

FOREIGN PATENT DOCUMENTS

| | | | |
|---|---|---|---|
| 4141334 | 6/1993 | Germany | 4/593 |
| 1080712 | 8/1967 | United Kingdom | 4/592 |

*Primary Examiner*—Robert M. Fetsuga

[57] ABSTRACT

A bathtub includes a bottom portion having a number of bulges extended downward, and a base having a number of orifice formed in the upper surface for engaging with the bulges. The base includes a number of blocks engaged in the bottom portion so as to form a stable supporting structure and includes an outer peripheral portion having a number of protrusions for engaging with a number of supports which further stably support the base and the bathtub. The bathtub includes a stable bottom and may be easily assembled.

1 Claim, 2 Drawing Sheets

BATHTUB ASSEMBLY

BACKGROUND OF THE INVENTION

1. Field of the Invention

The present invention relates to a bathtub, and more particularly to a bathtub assembly.

2. Description of the Prior Art

Typical bathtub assemblies comprise a base portion that may not be stably supported in place. The support structure includes a rather complicated configuration that is adverse for manufacturing and for assembling purposes. Three unstable and complicated examples of the bathtub assemblies are disclosed in U.S. Pat. No. 4,290,154 to Benjamin; U.S. Pat. No. 4,541,130 to Calvert et al., and U.S. Pat. No. 4,551,869 to Whitney.

The present invention has arisen to mitigate and/or obviate the afore-described disadvantages of the conventional bathtub assemblies.

SUMMARY OF THE INVENTION

The primary objective of the present invention is to provide a bathtub assembly which may be easily assembled and which includes a stable bottom.

In accordance with one aspect of the invention, there is provided a bathtub assembly comprising a bathtub body including an upper peripheral portion having a flange formed thereon and including a bottom portion having at least one bulge extended therefrom, a base including an upper surface having at least one orifice formed therein for engaging with the bulge, and including a bottom portion having a plurality of spaces formed therein, and including an outer peripheral portion having a plurality of protrusions formed thereon, the protrusions each including a groove formed therein, a plurality of blocks engaged in the spaces for stably supporting the base and the bathtub body, a plurality of supports each including an aperture formed therein for engaging with the protrusions and for engaging with the grooves of the protrusions, the supports each including a puncture formed therein and opposite to the aperture, and at least one board including at least one hook means for engaging with the flange of the bathtub body and including at least one projection for engaging with the puncture of the supports so as to secure the board to the supports and to the bathtub body.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
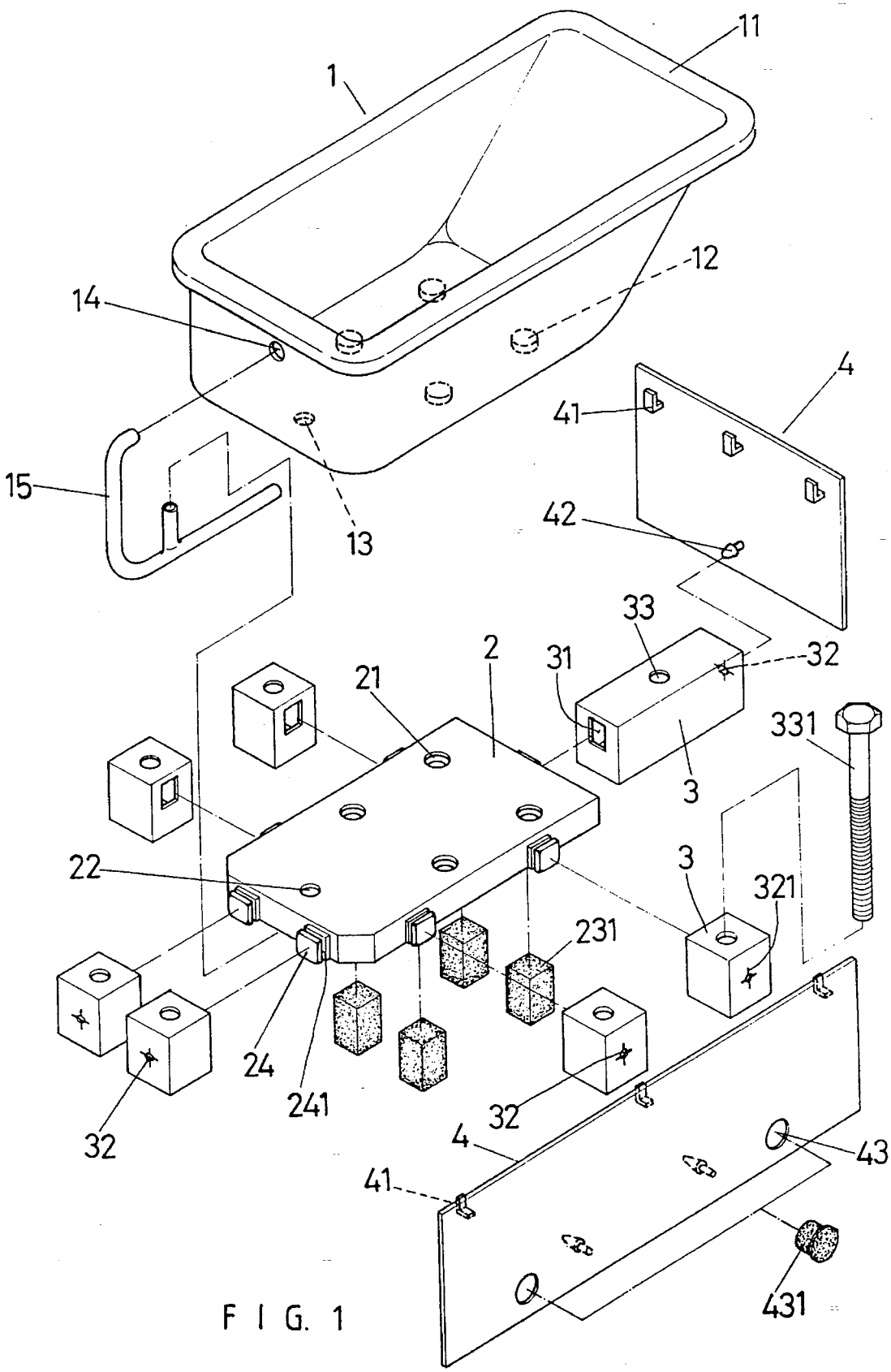
FIG. 1 is an exploded view of a bathtub assembly in accordance with the present invention.
Figures 2, 3:
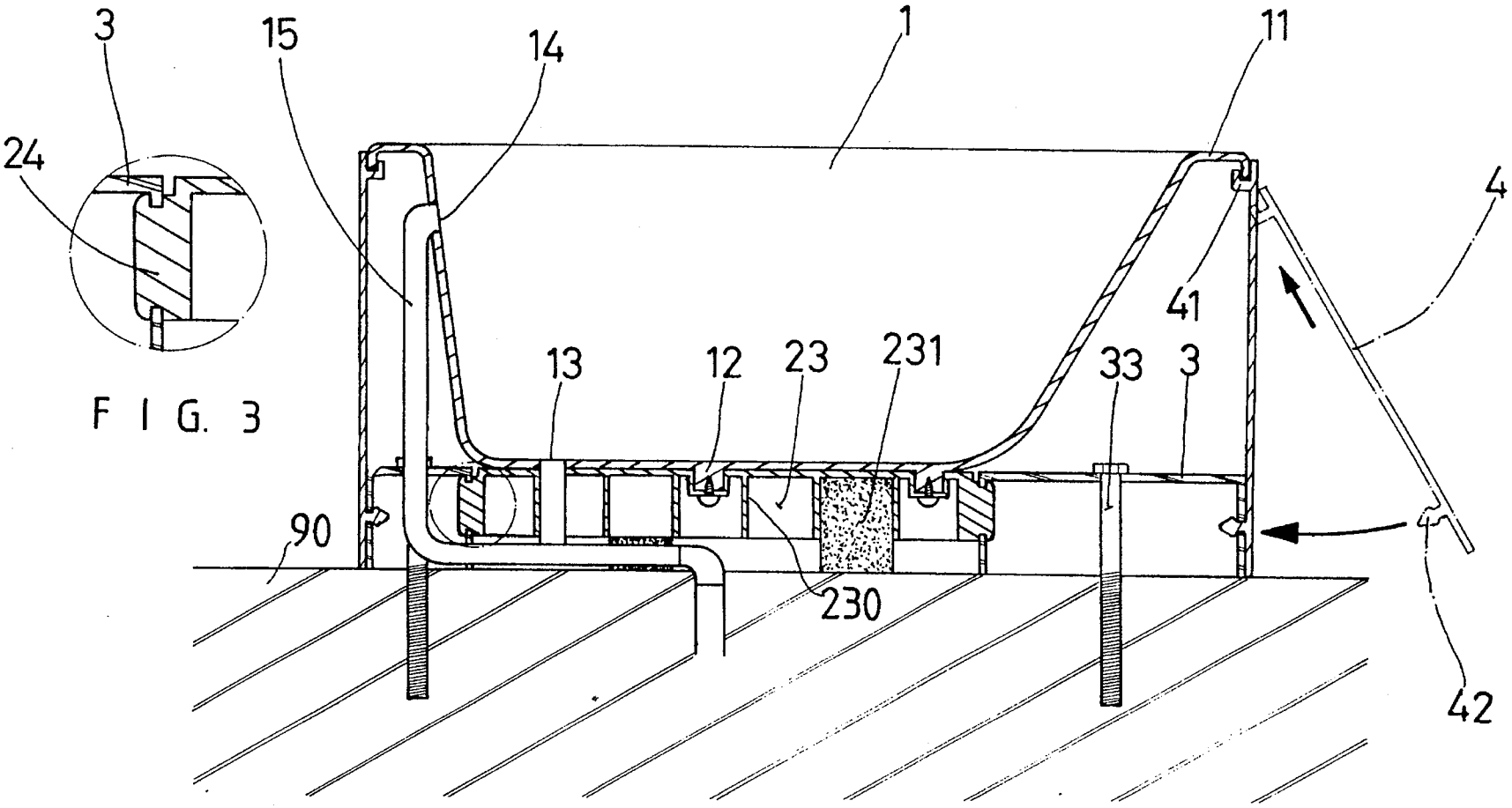
FIG. 2 is a cross sectional view of the bathtub assembly.
FIG. 3 is an enlarged partial cross sectional view illustrating portion of the bathtub assembly.

Referring to the drawings, a bathtub assembly in accordance with the present invention comprises a bathtub body 1 including a peripheral flange 11 provided on the upper peripheral portion thereof, including two holes 13, 14 for engaging with a conduit 15, and including a number of bulges 12 extended downward from the bottom thereof. A base 2 includes a number of orifices 21 for engaging with the bulges 12 and includes a hole 22 for aligning with the hole 13 for engaging with the conduit 15. Screws may be provided for securing the base 20 to the body 1. The base 2 includes a bottom portion having a number of partitions 230 provided therein so as to form a number of spaces 23 for engaging with a number of blocks 231. The blocks 231 can be arranged in suitable spaces 23 for stably supporting the bathtub body 1 and for forming channel means therebetween for engaging with the conduit 15, best shown in FIG. 2. The base 2 further includes an outer peripheral portion having a number of protrusions 24 each including a groove 241 formed therein.

A number of supports 3 each includes an aperture 31 formed therein for engaging with the protrusions 24 and for engaging with the grooves 241 so as to secure the supports 3 to the base 2, best shown in FIGS, 2 and 3. The supports 3 each further includes a puncture 32 opposite to the aperture 31 and having four slits 321 extended radially outward from the puncture 32. The supports 3 each further includes a hole 33 formed in the upper portion for engaging with bolts 331 which may solidly secure the supports 3 to the ground 90. Two or more side boards 4 each includes a number of hooks 41 for engaging with the flange 11 of the bathtub body 1 and each includes at least one projection 42 for engaging with the punctures 32 of the supports 3 so as to secure the side boards 4 to the bathtub body 1 and to the supports 3. The side boards 4 may include one or more holes 43 formed therein for handling or for moving the boards 4 and plugs 431 are provided for enclosing the holes 43.

Accordingly, the bathtub assembly in accordance with the present invention includes a configuration that may be easily assembled and that includes a stable bottom.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim

1. A bathtub assembly comprising a bathtub body including an upper peripheral portion having a flange formed thereon and including a bottom portion having at least one bulge extended therefrom, a base including an upper surface having at least one orifice formed therein for engaging with said bulge, and including a bottom portion having a plurality of spaces formed therein, and including an outer peripheral portion having a plurality of protrusions formed thereon, said protrusions each including a groove formed therein, a plurality of blocks engaged in said spaces for stably supporting said base and said bathtub body, a plurality of supports each including an aperture formed therein for engaging with said protrusions and for engaging with said grooves of said protrusions, said supports each including a puncture formed therein and opposite to said aperture, and at least one board including at least one hook means for engaging with said flange of said bathtub body and including at least one projection for engaging with said puncture of said supports so as to secure said board to said supports and to said bathtub body.

* * * * *